United States Patent [19]

Hanson

[11] Patent Number: 4,917,241

[45] Date of Patent: Apr. 17, 1990

[54] CAMERA CASE

[76] Inventor: William L. Hanson, 101 Salmo Beach, Tacoma, Wash. 98407

[21] Appl. No.: 19,645

[22] Filed: Feb. 27, 1987

[51] Int. Cl.[4] ..... A45G 11/38

[52] U.S. Cl. ..... 206/316.2

[58] Field of Search ..... 150/52 J; 206/316, 316.2

[56] References Cited

U.S. PATENT DOCUMENTS

| | | | |
|---|---|---|---|
| 2,136,357 | 11/1938 | Darling et al. | 150/52 J |
| 2,323,053 | 6/1943 | Kupferschmid | 150/52 J |
| 4,136,726 | 1/1979 | Lee | 150/52 J |
| 4,176,701 | 12/1979 | Welgan | 150/52 J |
| 4,549,589 | 10/1985 | Nguyen | 150/52 J |
| 4,601,318 | 7/1986 | Diegelman | 150/52 J |

FOREIGN PATENT DOCUMENTS

| | | | |
|---|---|---|---|
| 1155321 | 10/1963 | Fed. Rep. of Germany | 150/52 J |
| 2338945 | 2/1975 | Fed. Rep. of Germany | 150/52 J |

*Primary Examiner*—William Price

[57] ABSTRACT

A camera case is disclosed which houses the various components of a camera individually and is capable of assembly and disassembly. The case stays in place during storage and in use.

2 Claims, 1 Drawing Sheet

FIG. 1
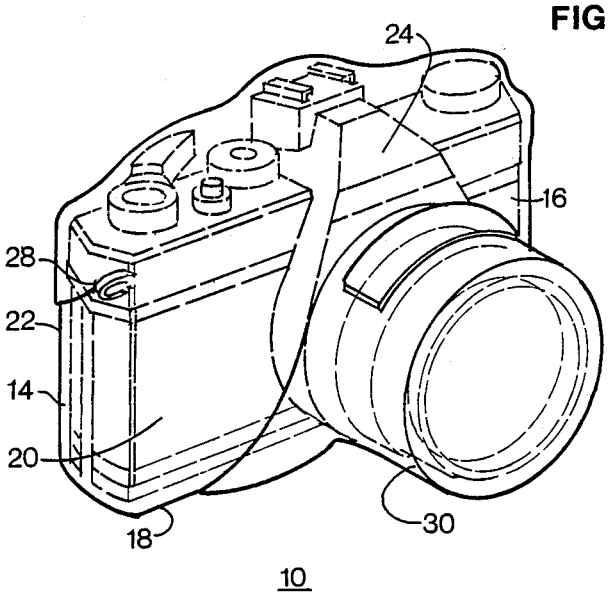
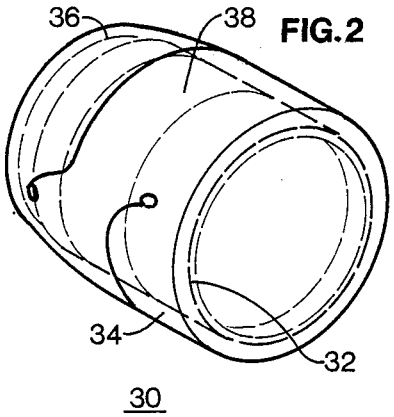
FIG. 2
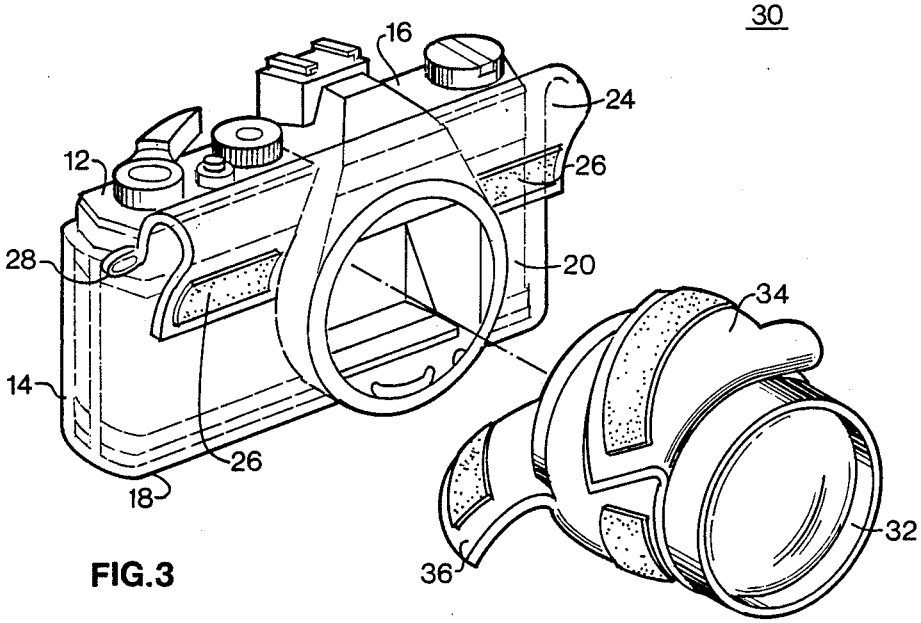
FIG. 3

CAMERA CASE

BACKGROUND OF THE INVENTION

A camera case is essential for the protection of a camera body and components. To maximize effectiveness, the case should provide a protective shell both when the camera is being operated and when the camera is being carried and stored.

In the Nguyen Patent No. 4,549,589, a case for holding interchangeable lens is illustrated. The case allows interchangeable lenses to be inserted into the camera housing. However, the case is designed for protection when the camera is not in use, and when in use, the cover is taken off.

In the Denmat Patent No. 4,383,565 a lens case only is illustrated. The lens case can be used to protect the lens when it is either mounted on a camera or removed. As a lens case only it is not designed as a complete protection system for a camera unit.

SUMMARY OF THE INVENTION

The present invention protects the camera when the camera body and components are in use and when carried and stored. The cases for the various lenses utilize adjustable end flaps thereby allowing full protection when the lens is not in use, and complete protection when the lens is attached and being used in conjunction with the camera.

The case itself provides complete protection both when the camera is in and out of use. When not in use, the housing covers all aspects of the camera. A lens is always attached to the body of the camera except when lenses are being changed. A flap at the top of the body portion of the case gives access to the camera controls. This flap is easily positioned out of the way for operation, yet remains attached to the case. The forward flap on the lens is easily positioned out of the way, permitting complete operation of the camera with the entire case remaining on the camera.

In addition, each lens case remains attached to each lens. When a lens is mounted on the camera, that lens case becomes part of the overall camera case. When that lens is removed from the camera, the specific lens case stays with that lens and becomes the storage case for that lens.

BRIEF DESCRIPTION OF THE DRAWINGS

FIG. 1 is a perspective view of the protective camera case fully encapsulating a camera. The camera is not in use.

FIG. 2 is a perspective view of the protective lens case enclosing the lens.

FIG. 3 is a side view of the protective lens case with the flaps extended, thereby providing for the coupling of the camera to the lens. The lens case also is illustrated with the flaps extended and thereby in a position for use.

DETAILED DESCRIPTION OF THE DRAWINGS

In FIG. 1, the protective case 10 is illustrated fully protecting the camera 12 when the camera 12 is not in use. The protective case 10 utilizes main body 14 which provides a housing for the body 16 of the camera 12.

The main body 14 of the protective case 10 utilizes floor 18 and front 20 and rear sides 22 of the case.

Attached to front side 20 of the case 10 is extension flap 24. The extension flap 24 protects the working mechanisms on the shoulder of the camera. The flap attaches to the main body 14 of the protective case by means of interlocking Velcro strips 26. When the user wishes to utilize the mechanisms on the top of the camera, the user merely flips up extension flap 24.

In the preferred embodiment, the extension flap 24 and the balance of the protective case 10 is made of flexible, crushable, waterproof material such as "Nylon 2". "Nylon 2" is neoprene rubber secured between two layers of nylon. The extension flap 24 is cut at points 28 thereby allowing the user to merely flip the extension flap 24 forward.

Illustrated in FIG. 2 is protective lens casing 38. The protective lens casing 38 includes protective cylinder 30. The protective cylinder 30 surrounds lens 32. Attached to both ends of the protective cylinder are flaps 34 and 36. Both flaps are capable of rotating free form the protective cylinder 30.

As set forth in FIG. 3, if the user wishes to connect a lens 32 to the body of the camera 16, the user releases flaps 34 and 36 from either end of the protective cylinder 30, and attaches the lens 32 to the camera.

If the user wishes to change lenses, the existing lens is disconnected. The operation of changing lenses is done with the case remaining on the camera. The flap 34 is rotated free, thereby allowing the lens to be connected to the camera.

When the user closes up the camera 16, the flap 24 is rotated to its attachment to the body of the protective case. It is to be noted that the attachment of the flaps can be set at various positions.

Although a particular embodiment of the invention has been disclosed above for illustrative purposes, it is to be understood that variations or modifications thereof which lie within the scope of the appended claims are contemplated.

I claim:

1. A camera and lens protective case system comprising:

a case of flexible material covering the bottom two sides, back and front less a cut-out for the lens, of a camera;

a cylindrical housing of flexible material surrounding a lens with a rotatable flap at the lens protective end of the housing;

a flap which is permanently and rotatably affixed to the rear portion of the surrounding lens housing, the length of said rotatable flap being sufficient that when it is unfastened from the surrounding lens material, it can be re-fastened to the rear of the case; and a flap of flexible material secured to the top of said case capable of rotating free of the camera operating mechanisms and still remaining attached to the protective case.

2. The camera and lens protective case system of claim 1 wherein the flap of flexible material secured to the top of the case is permanently and rotatably affixed to the front side of the case, and is affixed by a fastening means to the rear side of the case.

* * * * *